US009228712B2

(12) United States Patent
Chen

(10) Patent No.: US 9,228,712 B2
(45) Date of Patent: Jan. 5, 2016

(54) DAY RUNNING LAMP FOR MOTOR VEHICLE AND MOTOR VEHICLE HAVING SAME

(71) Applicant: HON HAI PRECISION INDUSTRY CO., LTD., New Taipei (TW)

(72) Inventor: Po-Chou Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 75 days.

(21) Appl. No.: 14/144,349

(22) Filed: Dec. 30, 2013

(65) Prior Publication Data

US 2014/0307457 A1 Oct. 16, 2014

(30) Foreign Application Priority Data

Apr. 12, 2013 (TW) ..... 102112950 A

(51) Int. Cl.
*F21V 1/00* (2006.01)
*F21S 8/10* (2006.01)

(52) U.S. Cl.
CPC ..... *F21S 48/21* (2013.01); *F21S 48/2212* (2013.01); *F21S 48/24* (2013.01)

(58) Field of Classification Search
CPC ..... F21S 48/21; F21S 48/2212; F21S 48/24
USPC ..... 362/516, 509, 259
See application file for complete search history.

(56) References Cited

U.S. PATENT DOCUMENTS 9,103,959 B2 * 8/2015 Jeong ..... G02B 6/003 1/1
2014/0003071 A1 * 1/2014 de Lamberterie ..... F21S 48/24 362/487

* cited by examiner

*Primary Examiner* — Ali Alavi
(74) *Attorney, Agent, or Firm* — Novak Druce Connolly Bove + Quigg LLP

(57) ABSTRACT

A day running lamp includes a laser light source, a light splitting element, a number of light path adjusting elements, a number of scattering elements, and a lampshade. The laser light source is configured for emitting a single laser beam, and the splitting element is configured for splitting the single laser beam into a number of divided beams. Each of the light path adjusting elements is configured for adjusting a light path of corresponding divided beams into parallel beams. The scattering elements are configured for diffusing the parallel divided beams onto the lampshade.

18 Claims, 2 Drawing Sheets

DAY RUNNING LAMP FOR MOTOR VEHICLE AND MOTOR VEHICLE HAVING SAME

BACKGROUND

1. Technical Field

The present disclosure relates to day running lamps and motor vehicles having the day running lamps.

2. Description of Related Art

Traffic signal lamps, such as day running lamp are mainly used when driving in foggy or rainy weather. However, the traffic signal lamps usually include multiple light-emitting diodes (LEDs) as a light source to achieve a required brightness, which may cause accumulation of heat.

Therefore, it is desirable to provide a traffic signal lamp for use in a motor vehicle to overcome the above-mentioned problems.

DETAILED DESCRIPTION

Figure 1:
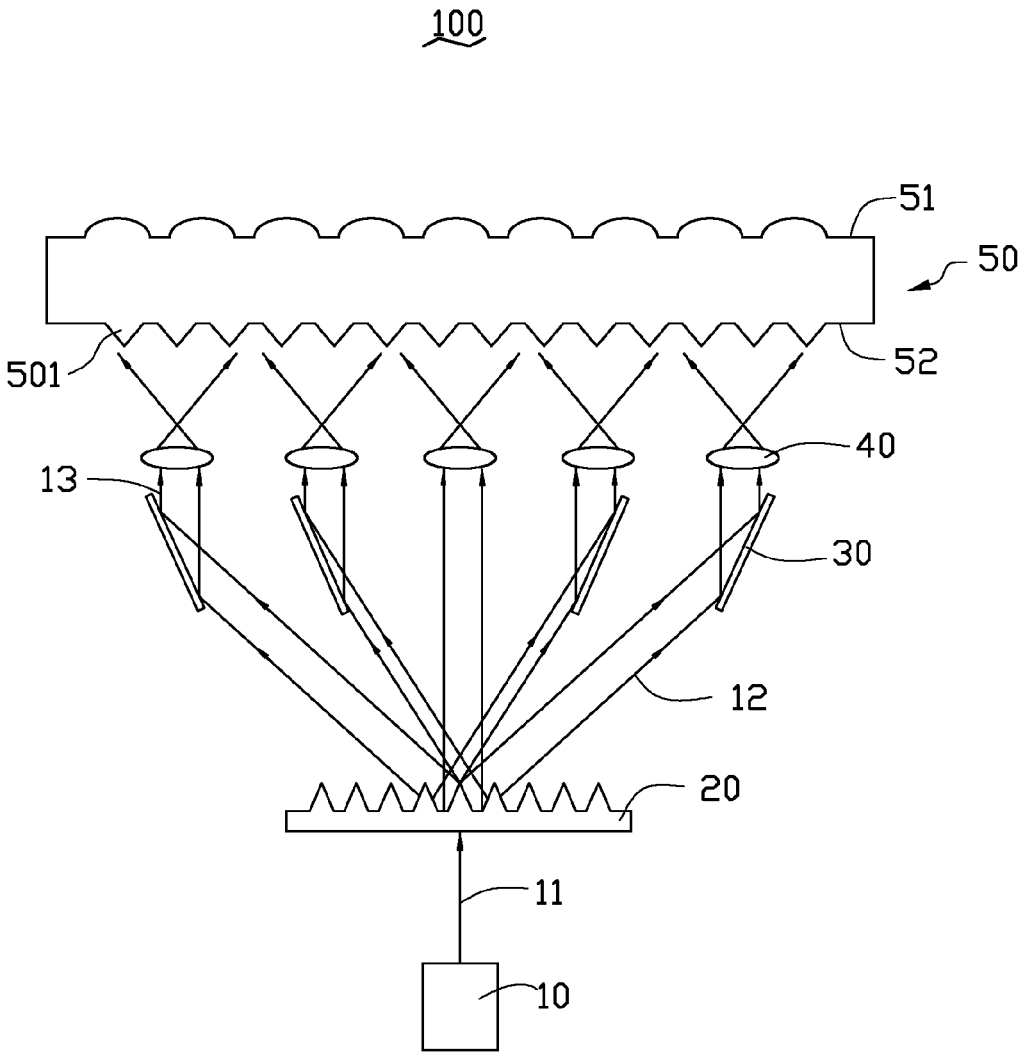
FIG. 1 is an isometric view of an embodiment of a day running lamp.

FIG. 1 shows an embodiment of a day running lamp 100. The day running lamp 100 includes a laser light source 10, a light-splitting element 20, a number of light path adjusting elements 30, a number of scattering elements 40, and a lampshade 50.

The laser light source 10 is configured for emitting a single laser beam 11. In one embodiment, the laser light source 10 is a laser diode. The splitting element 20 is configured for splitting the single laser beam 11 into multiple split beams 12. In one embodiment, the light splitting element 20 is a diffraction grating. The laser light source 10 faces a substantially central portion of the splitting element 20.

A number of the divided split beams 12 is dependent on a diffraction order of the splitting element 20. In the illustrated embodiment, the number of the divided laser beams 12 is ten. The diffraction order "m" satisfies an equation: $m\lambda=\Lambda(n_2\sin\theta_{dif}-n_1\sin\theta_{inc})$, wherein "λ" represents a wavelength of the laser beam, "Λ" represents a grating period of the splitting element 20, "$n_1$" represents a refractive index of a medium for transferring an incident laser beam, "$n_2$" represents a refractive index of a medium for transferring an incident diffracted laser beam, "$\theta_{inc}$" represents an incident angle of the incident laser beam, and "$\theta_{dif}$" represents a diffraction angle of the diffracted laser beam.

The light path adjusting element 30 is configured for adjusting the split beams 12 into parallel split beams 13, which are substantially parallel to the laser beam 11 from the laser light source 10. In one embodiment, the light path adjusting elements 30 are reflectors. Each split beam 12 transmitted from the splitting element 20 is reflected by the light path adjusting element 30 and transmitted along a direction substantially parallel to the laser beam 11. In other embodiments, if the split beams 12 are transmitted along the direction substantially parallel to the laser beam 11, the light path adjusting elements 30 can be omitted.

The scattering elements 40 are arranged at intervals from each other and are substantially parallel to each other. In the illustrated embodiment, the scattering elements 40 are arranged in a same plane. The scattering elements 40 are configured for diffusing the parallel divided beams 13. The scattering elements 40 can be, but are not limited to, a concave lens, a Fresnel lens, or a convex lens. In one embodiment, the scattering elements 40 are a convex lens, and a distance between the scattering elements 40 and the lampshade 50 is larger than a focal length of the scattering elements 40, so the parallel divided beams 13 are diverged and scattered onto the lampshade 50.

The lampshade 50 is arranged in a light-outputting path of the scattering elements 40. The lampshade 50 includes a first surface 51 and a second surface 52 opposite from the first surface 51. The second surface 52 faces the scattering elements 40. The first surface 51 and the second surface 52 both include a number of microstructures 501. In the illustrated embodiment, the microstructures 501 on the second surface 52 are a conical convex array, and the microstructures on the first surface 51 are a hemispherical convex array. In other embodiments, the first surface 51 and the second surface 52 are atomization surfaces.

In summary, by using the laser light source 10 as the only light source in the day running lamp 100, accumulation of heat is prevented.

Figure 2:
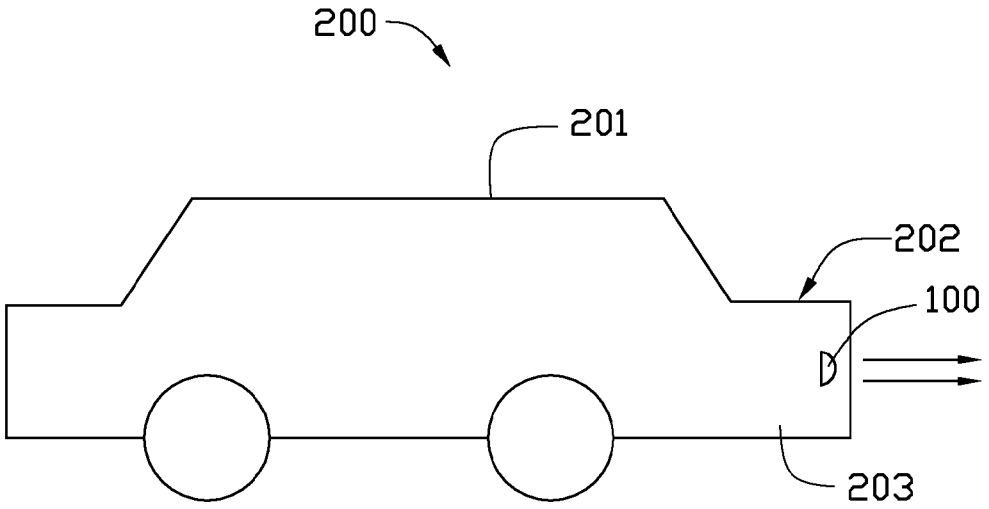
FIG. 2 is a schematic view of a motor vehicle using the day running lamp in FIG. 1.

FIG. 2 shows a schematic diagram of a motor vehicle 200 using the day running lamp 100. The motor vehicle 200 uses two day running lamps 100, one on each side of a front of the motor vehicle 200.

It is to be understood that even though numerous characteristics and advantages of the present embodiments have been set forth in the foregoing description, together with details of the structures and functions of the embodiments, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A day running lamp comprising:

a laser light source being configured for emitting a laser beam;

a light splitting element, the light splitting element being arranged on a light outputting path of the laser light source and configured for splitting the laser beam emitted from the laser light source into a plurality of divided beams;

a plurality of light path adjusting elements, each of the light path adjusting element being arranged in the transmission direction of the corresponding divided beam and configured for adjusting the light path of the divided beam into parallel to the laser beam from the laser light source;

a plurality of scattering elements, the scattering element are arranged in parallel and at intervals and configured for receiving the paralleled divided beams and diffusing the divided beams; and a lampshade being arranged on light outputting paths of the scattering elements, and the diffused laser beams reach the lampshade.

2. The day running lamp of claim 1, wherein the laser light source is a laser diode.

3. The day running lamp of claim 2, wherein each of the light path adjusting element is a reflector.

4. The day running lamp of claim 3, wherein each of the scattering elements is a concave lens.

5. The day running lamp of claim 3, wherein each of the scattering elements is a convex lens.

6. The day running lamp of claim 5, wherein the light splitting element is a diffracting grating.

7. The day running lamp of claim 6, wherein the laser light source is arranged facing to a center of the splitting element.

8. The day running lamp of claim 7, wherein the lampshade comprises a first surface and a second surface opposite to the first surface, the second surface is arranged facing the scattering element, the first surface and the second surface comprise a plurality of micro structures.

9. The day running lamp of claim 8, wherein the micro structures are a conical convex array or a hemispherical convex array.

10. The day running lamp of claim 9, wherein the first surface and the second surface are atomization surfaces.

11. The day running lamp of claim 1, wherein the scattering elements are arranged in a same plane.

12. A motor vehicle, comprising:

a vehicle body and a vehicle head connecting with the vehicle body; and comprising at least one day running lamps mounted on the vehicle head, each of the day running lamps comprising:

a laser light source being configured for emitting a single laser beam;

a light splitting element, the light splitting element being arranged on a light outputting path of the laser light source and configured for splitting the laser beam emitted from the laser light source into a plurality of divided beams;

a plurality of light path adjusting elements, each of the light path adjusting element being arranged in the transmission direction of the divided beam and configured for adjusting the light path of the divided beam into parallel to the laser beam from the laser light source;

a plurality of scattering elements, the scattering element are arranged in parallel and at intervals and configured for receiving the paralleled divided beams and diffusing the divided beams; and a lampshade being arranged on light outputting paths of the scattering elements, and the diffused laser beams reach the lampshade.

13. The motor vehicle of claim 12, wherein the laser light source is a laser diode.

14. The motor vehicle of claim 13, wherein the each of the light path adjusting elements is a reflector.

15. The motor vehicle of claim 14, wherein each of the scattering elements is a concave lens or a convex lens.

16. The motor vehicle of claim 15, wherein the light splitting element is a diffracting grating.

17. The motor vehicle of claim 16, wherein the lampshade comprises a first surface and second surface opposite to the first surface, the second surface is arranged facing the scattering element, the first surface and the second surface comprises a plurality of micro structures.

18. The motor vehicle of claim 17, wherein the scattering elements are arranged in a same plane.

* * * * *